US006655131B1

(12) United States Patent
Baeuerle et al.

(10) Patent No.: US 6,655,131 B1
(45) Date of Patent: Dec. 2, 2003

(54) METHOD OF PROTECTING A CATALYTIC CONVERTER

(75) Inventors: Michael Baeuerle, Markgroeningen (DE); Klaus Ries-Mueller, Bad Rappenau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/717,062

(22) Filed: Nov. 22, 2000

(30) Foreign Application Priority Data

Nov. 26, 1999 (DE) ..... 199 56 936

(51) Int. Cl.[7] ..... F01N 3/00

(52) U.S. Cl. ..... 60/285; 60/274; 60/277; 60/286; 73/116

(58) Field of Search ..... 60/274, 277, 284, 60/285, 286, 301; 73/116, 117.3; 123/179.16, 436, 481, 491, 435

(56) References Cited

U.S. PATENT DOCUMENTS 4,026,106 A * 5/1977 Tamazawa et al. ..... 60/277
4,083,234 A * 4/1978 Aono et al. ..... 60/277
4,128,998 A * 12/1978 Hattori et al. ..... 60/277
5,138,833 A * 8/1992 Kabasin et al. ..... 60/285
5,168,859 A * 12/1992 Ohsaki ..... 73/116
5,231,869 A 8/1993 Klenk et al.
5,653,209 A * 8/1997 Johansson et al. ..... 123/435
5,934,072 A * 8/1999 Hirota et al. ..... 60/301
6,253,547 B1 * 7/2001 Watanabe et al. ..... 60/274
6,286,305 B1 * 9/2001 Poublon et al. ..... 60/285

* cited by examiner

*Primary Examiner*—Binh Tran
*Assistant Examiner*—Tu M. Nguyen
(74) *Attorney, Agent, or Firm*—Walter Ottesen

(57) ABSTRACT

The invention is directed to a method for protecting a catalytic converter in the exhaust gas of an internal combustion engine in a starting operation of the engine. An index is formed for the quantity of an air/fuel mixture which will first react exothermally in the catalytic converter downstream of the engine. The index is compared to a predetermined threshold value and fuel metering is cut off when the threshold value is exceeded.

6 Claims, 3 Drawing Sheets

METHOD OF PROTECTING A CATALYTIC CONVERTER

BACKGROUND OF THE INVENTION

With a defective or missing combustion of the cylinder charge of an internal combustion engine, the cylinder charge is, under some circumstances, exothermally converted in the downstream catalytic converter. If this fault occurs with a certain frequency, this leads to irreversible damage of the catalytic converter by overheating.

In connection with the endangerment of the catalytic converter, it is known from U.S. Pat. No. 5,231,869 to detect misfires on the basis of an evaluation of crankshaft speeds within predetermined crankshaft angle sectors. In accordance with this publication, the fuel metering to the affected cylinder is interrupted when misfires occur. Furthermore, the misfire detection is intended, according to this publication, to be deactivated in specific operating conditions, inter alia, for a short time span after the start of the engine.

Especially with the starting of an engine with a hot catalytic converter, an overheating of the catalytic converter can occur when there are starting difficulties because of an air/fuel mixture not combusted in the cylinder. Imparting movement to a vehicle (for example, by allowing a vehicle to roll downhill in order to start the engine by releasing the clutch) is especially critical because, in this case, large quantities of uncombusted air/fuel mixture can reach the catalytic converter.

Accordingly, at the start and especially when imparting movement to the vehicle, there is the requirement to prevent supplying an uncombusted air/fuel mixture to the catalytic converter.

An expansion of the misfire detection disclosed in U.S. Pat. No. 5,231,869 to the time region after a start or during a start attempt has been shown to be especially inadequate especially in the critical case of imparting movement to the vehicle.

SUMMARY OF THE INVENTION

It is an object of the invention to provide a method with which damage to a catalytic converter can be avoided even during start difficulties, especially in the critical case of imparting movement to a vehicle as described above.

The method of the invention is for protecting a catalytic converter in the exhaust gas of an internal combustion engine in a starting operation of the engine. The method includes the steps of: forming an index for the quantity of an air/fuel mixture which will first react exothermally in the catalytic converter downstream of the engine; comparing the index to a predetermined threshold value; and, cutting off the metering of fuel when the threshold value is exceeded.

The invention reduces the danger of damage to the catalytic converter when there are starting difficulties.

The invention requires no additional complexity with respect to the apparatus when using the signal detection which is anyway provided for detecting combustion misfires. This signal detection is based on the fluctuations of the angular velocity of the crankshaft. The combustions in the time region after the start can be detected via the changed signal detection and signal processing. The change of the signal detection supplies an advantageous possibility for carrying out the invention.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
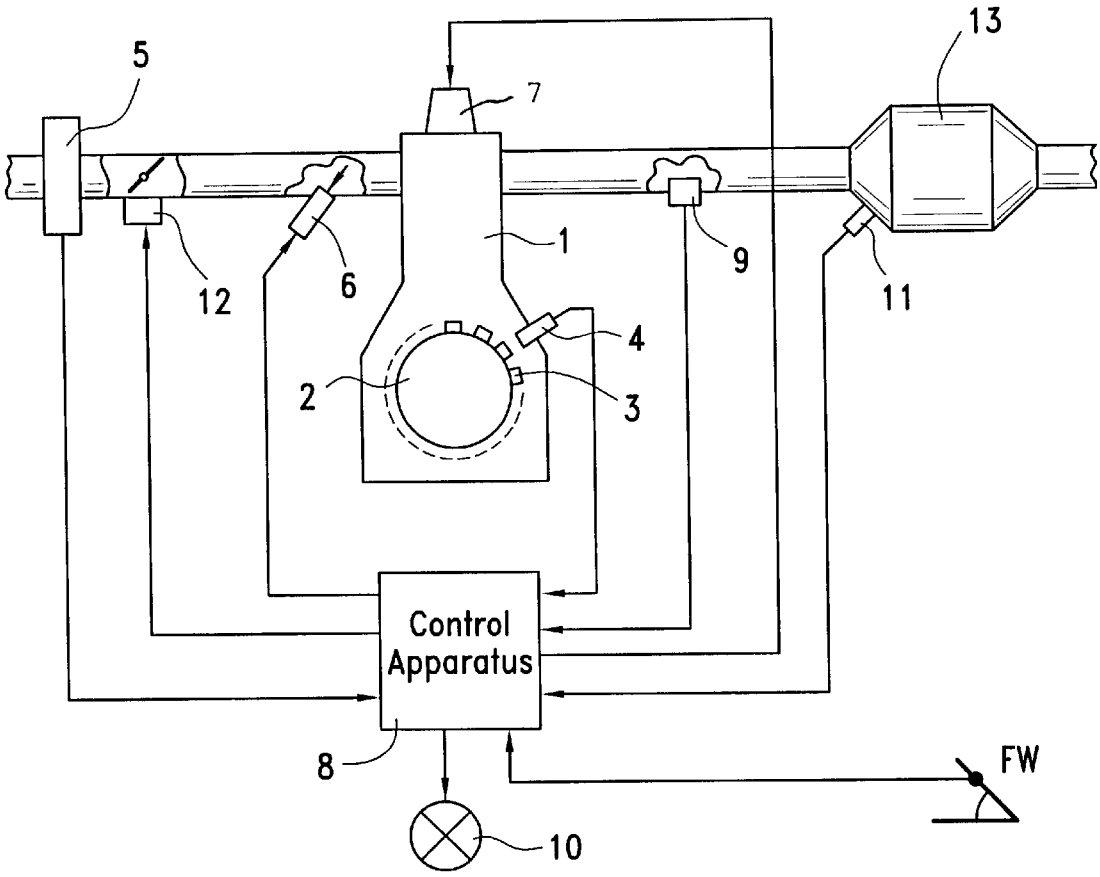
FIG. 1 shows the technical background of the method of the invention.

FIG. 1 shows an internal combustion engine 1 having an angle transducer wheel 2 having markings (teeth) 3 as well as an angle sensor 4, a device 5 for detecting the air quantity ml, which flows into the engine, a fuel metering device 6, an ignition device 7 and a control apparatus 8 as well as a fault lamp 10, an exhaust-gas sensor 9, a throttle flap actuating element 12 and means FW for detecting the torque wanted by the driver. The device 5 for detecting the air flow ml can, for example, be a hot film air mass sensor and the fuel metering device 6 can, for example, be an injection valve device. Optionally, a sensor 11 can be provided for detecting the temperature T of the catalytic converter 13.

The signal of the hot film air mass sensor supplies a signal representing the air quantity ml which flows into the engine. The rpm (n) of the engine can be determined from the signal of the angle sensor 4. The engine rpm (n) and the air quantity ml are the essential quantities for determining the fuel quantity which is metered to the engine via the injection valve device.

The angle transducer wheel is coupled to the crankshaft of the engine. The rotational movement of the angle transducer wheel is converted into an electrical signal with the aid of the angle sensor 4 realized as an inductive sensor. The periodicity of this signal presents an image of the periodic passing of the markings 3 at the angular sensor 4. The time duration (tooth time) between an increase and a drop of the signal level therefore corresponds to the time in which the crankshaft has rotated through an angular region corresponding to the extent of a marking. The tooth times are inversely proportional to the rpm. The trace of the tooth times therefore mirrors the trace of the rpm.

During a combustion, a characteristic change of the rpm trace occurs because of the torque change. The amplitude of the rpm signal (that is, of the tooth time signal) is approximately proportional to the outputted torque and is evaluated for the detection of combustions in accordance with the invention.

Figure 2:
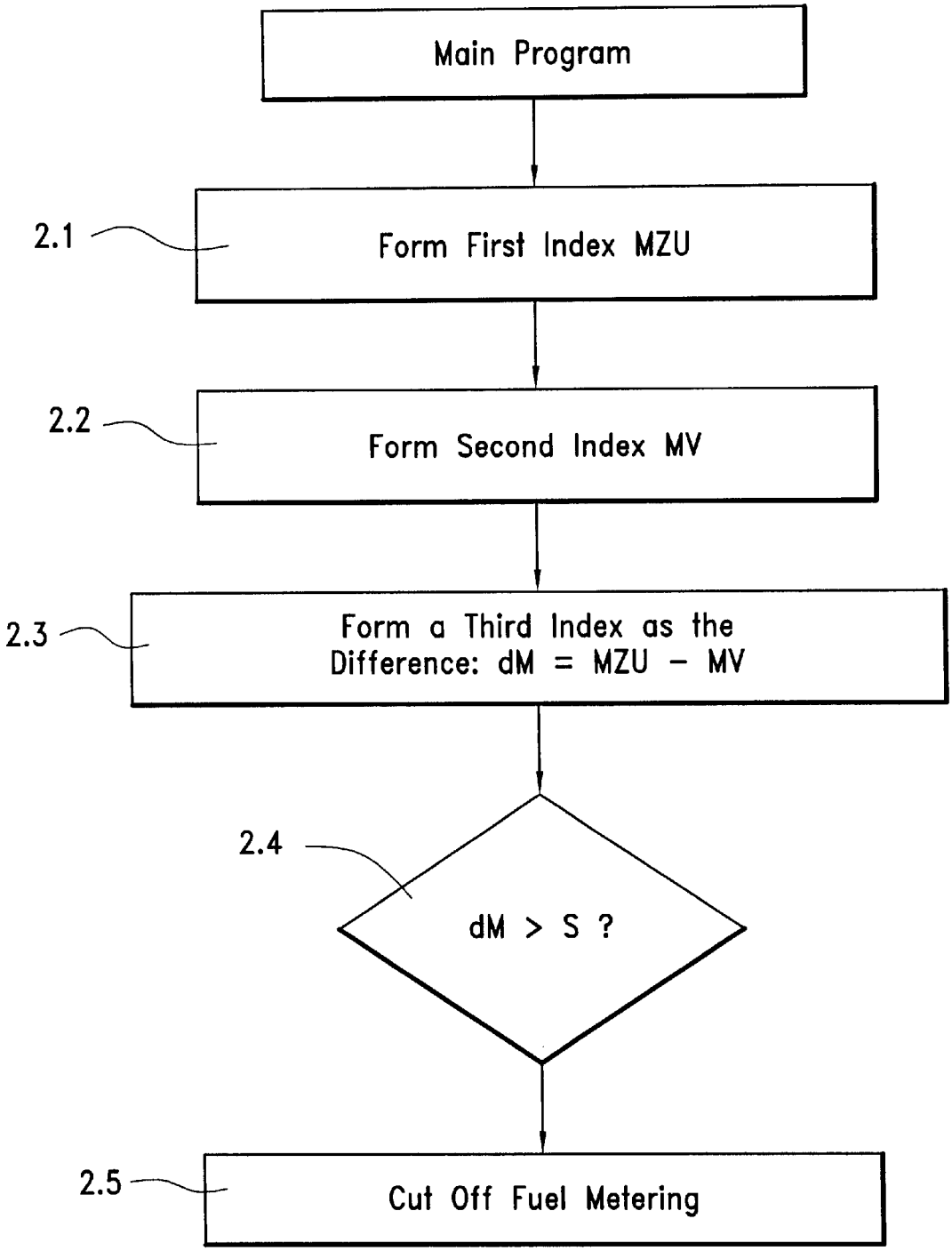
FIG. 2 shows a flowchart representative of an embodiment of the method of the invention; and, FIG. 3 is a graph of tooth times plotted as a function of the crankshaft angle to show a possibility of the combustion detection.

FIG. 2 shows a flowchart representing an embodiment of the method of the invention.

According to the invention, in step 2.1, a first index MZU is computed for the quantity of the air/fuel mixture metered starting at the time point of the beginning of the starting operation.

For this purpose, the injections can be counted or the injection times can be summed. Alternatively, the air quantity can be determined which has flowed into the engine since the beginning of the start operation.

Furthermore, the formation of a second index MV for the actual fuel/air mixture quantity, which is combusted in the engine, takes place in step 2.2.

For this purpose, the number of actual combustions are counted. An example of a method for detecting the actual combustions is described hereinafter.

In step 2.3, the difference dM is formed as a third index from the first and second indices. The difference dM of the two indices is proportional to the amount of energy which can be released as heat in the catalytic converter.

If the value of the difference dM exceeds a predetermined threshold value S in step 2.4, then, in step 2.5, a cutoff of the fuel metering takes place. Injections are then no longer carried out.

The threshold value can be dependent upon operating parameters. If, for example, data as to the temperature of the catalytic converter are present at the start, then the threshold value can be dependent upon the temperature of the catalytic converter. The higher the temperature of the catalytic converter, the more susceptible is the catalytic converter to damage from exothermal reactions. The threshold value is therefore selected lower with increasing temperature of the catalytic converter. The temperature of the catalytic converter can, for example, be detected by a temperature sensor or it can be modeled also from other operating characteristic variables. Thus, a conclusion can be drawn as to the temperature of the catalytic converter, for example, from the temperature of the cooling water and the time that the engine had been shut off. The shutoff time is the time which has elapsed since the engine has been switched off.

For additional reliability, the signal of the lambda probe can be applied. When lambda is in the region of 1 (stoichiometric ratio of air and fuel), it can be assumed that combustions are present.

To form the index for the actual energy, which is converted in the engine, a detection of the combustions is necessary. Detected combustions are summed and the sum defines the above-mentioned index.

In the following, a preferred embodiment for detecting combustions is explained.

Essentially, an evaluation of the difference between the maximum and the minimum of the tooth time trace between two ignitions takes place.

If the distance or interval is greater than a threshold value, then this is counted as a combustion.

Before counting, an assurance can be provided via a lambda evaluation. If lambda is in the region of 1, then combustions can be assumed.

Figure 3:
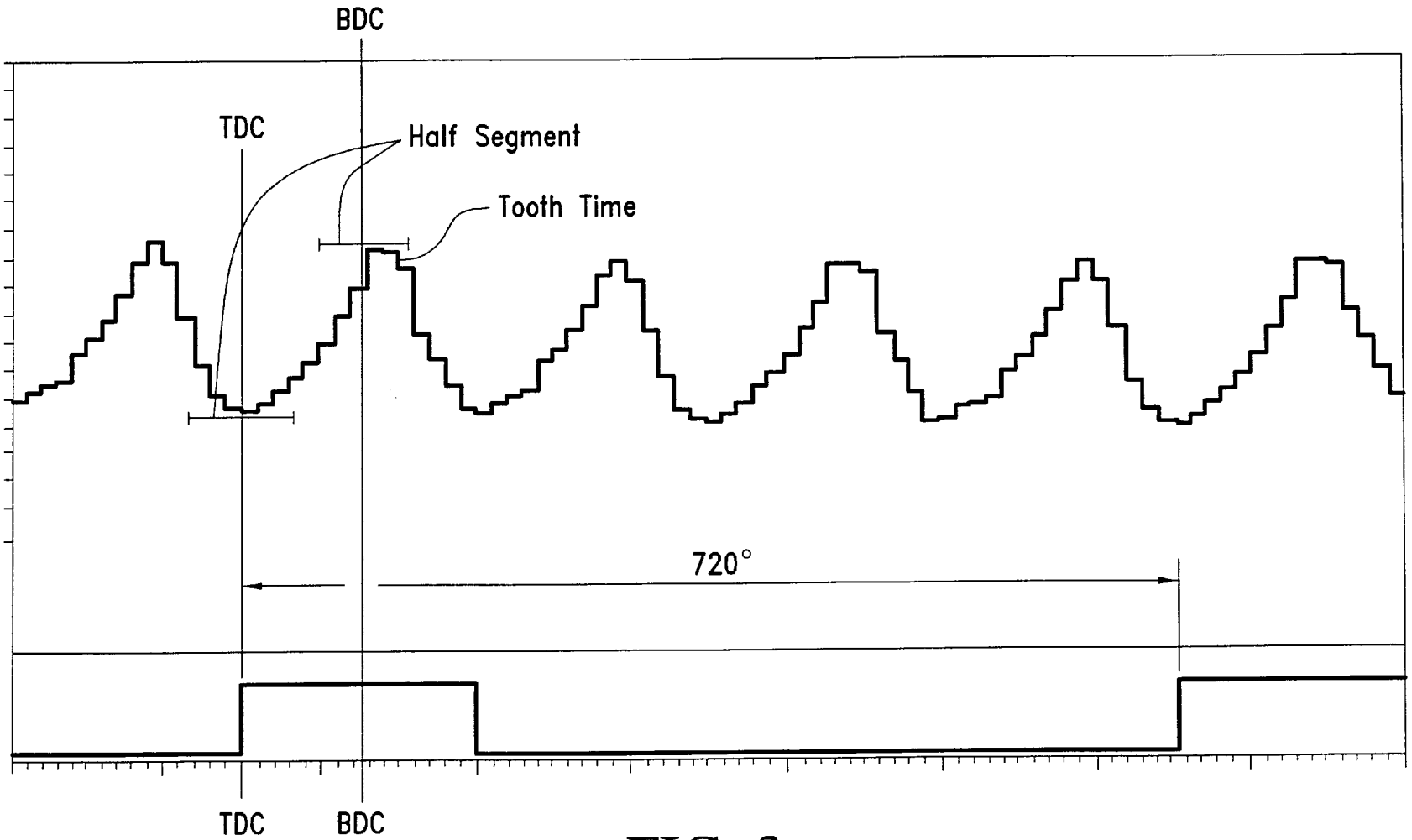

FIG. 3 shows tooth times plotted as a function of crankshaft angle. Each increase of the tooth times corresponds to a braking of the crankshaft. The compression work in advance of the combustion stroke and the friction operate, for example, in a braking manner. Each drop of the tooth times corresponds to an acceleration which is caused by the gas force which results from the combustion.

In conventional engine control apparatus having functions for detecting combustion misfires on the basis of changes in the angular velocity, individual teeth of the transducer wheel are not resolved as a function of time. If one would want to utilize the times of individual teeth, this would require a high manufacturing accuracy of the transducer wheel and/or an increase in computation capacity for the evaluation of the tooth time signals. In lieu thereof, the transducer wheel is conventionally subdivided into segments which include, for example, an angular range of 720° divided by the number of cylinders of the engine.

Accordingly, a segment typically includes 30 teeth for a 60 tooth transducer wheel and 4 cylinders. The segment times, which are assigned to these segments, are the times in which the segments move past the sensor. In the conventional misfire detection, one segment is measured for each cylinder. The relative position of the segments referred to the ignition top dead center of the individual cylinders exhibits no differences between different cylinders.

Differences of the segment times are formed and compared to a threshold value in the conventional function of detecting combustion misfires.

Differences occur when the cylinders differ in their combustion performance. For example, one cylinder of 4 cylinders does not operate. The segment times assigned to this cylinder are then comparatively large and thereby deviate from the segment times of the remaining cylinders. The smooth running is disturbed. This conventional method is suitable for the detection of misfires when the regular combustions are greater with respect to number.

For starting difficulties, these ratios are not necessarily given. In the extreme case, no combustions of any kind are present at the beginning so that the conditions of the cylinders with respect to each other do not differ or differ only slightly. The differences of the segment times are correspondingly small. These small differences cannot be reliably detected as misfires because they correspond to the undisturbed smooth running of an engine operation not affected by misfires. Stated otherwise, the regular engine operation without misfires as well as the case of the complete omission of combustions can appear in the conventional method as undisturbed smooth running. The reason for this is that segment times of different cylinders are compared to each other which only differ slightly from each other when no combustions whatsoever take place.

According to the invention, a changed segment time detection first takes place to detect combustions.

In the segment time detection change in accordance with the invention, two segment times are detected per cylinder. The one segment time lies ideally symmetrical to the maximum of the tooth times; whereas, the other one lies ideally symmetrical to the next minimum of the tooth times. In a four-cylinder engine, half segments could be provided (for example, each segment being 90° crankshaft angle wide) which include the upper top dead center (TDC) or the bottom dead center (BDC), respectively, and which each extend approximately symmetrically to this point. The allocation of crankshaft angle regions to the maximum and minimum values of the tooth times can be determined in any event experimentally and can be programmed in the control apparatus so that the used crankshaft angle segments have at least approximately the above-given ideal positions.

The identification or characterization as half segment relates to the halving of the segment width compared to the above-explained conventional method for the detection of combustion misfires.

The segment time, which is formed for the maximum of the tooth times, then defines, to a certain extent, a mean value of the maximum tooth times. In a like manner, the segment time, which is formed for the minimum of the tooth times, corresponds to the mean value of the minimum segment times.

The combustions can be detected based on the difference of these two segment times. The difference is large when combustions take place. Otherwise, the difference is small.

According to the invention, the differences are compared to a threshold value. Combustions are counted each time this threshold value is exceeded. The sum of the combustions defines the index MV (step 2.2 in FIG. 2).

In a further embodiment, a compensation of disturbance signals takes place as they are caused by mechanical transducer wheel tolerances and/or torsion oscillations of the crankshaft.

As in the embodiment described above, the additional embodiment includes the formation of segment times (summation of tooth times) over a specific angular region. Typically, half segment times tsh(k) are here also formed symmetrically about the bottom and top dead center points of the cylinder. The segment length is typically in degrees of crankshaft angle:

½*(720° crankshaft/number of cylinders)

k: index with double ignition frequency.

The above continues with a difference formation:

$$dtsh(k)=tsh(k+1)-tsh(k).$$

Additionally, a dynamic correction can be carried out. A mean rpm change or segment time change of the measured segment times is corrected via arithmetic mean value formation over one camshaft revolution.

$$tshm(k)=(tsh(k-zylza)-tsh(k+zylza))/(2*zylza) \text{ wherein}$$

zylza=number of cylinders of the engine. This yields the corrected segment time difference, namely:

$$dtshk(k)=dtsh(k)-tshm(k).$$

The quantity md(k) is formed by a normalization of the amount of dtshk over the rpm by means of a division by $tsh(k)^3$.

$$md(k)=|dtshk(k)|/tsh(k)^3.$$

In this way, the value md(k) is approximately independent of the engine rpm, that is, md(k) is approximately only dependent upon the outputted torque. Thereafter, a summation over one camshaft revolution takes place, namely, the summation over one camshaft revolution is the significant component of this embodiment because, in this way, disturbance components in the detection of the segment time drop out. These disturbance components occur because of transducer wheel faults or torsion oscillations of the engine.

$$md(i)=md(k-zylza)+md(k-(zylza-1))+\ldots+md(k)+\ldots+md(k+(zylza-2))+md(k+zylza-1)$$

wherein md(i) corresponds to the torque outputted over a camshaft revolution.

Note: To compensate for disturbance influences, a steady state operation is assumed for the sake of simplicity. This means, that the segment times for one camshaft revolution are the same, for example, 60 ms for 1000 rpm.

This means when a half segment is greater (for example, because of a mechanical inaccuracy), another half segment must be correspondingly smaller. In the sum, 60 ms must again result.

The above means that corresponding disturbance influences should not become effective.

This applies also approximately for the dynamic operation or the dynamic compensated segment times.

As an alternative method for combustion detection, disturbance influences can also be compensated when only the differences of the torques md(i), which are formed over one camshaft revolution, are formed. For example, $$dmd(i)=md(i+1)-md(i).$$

A compensation of this kind also takes place in the formation of a value dt(k) in accordance with the following rule:

$$dt(k)=(md(k-zylza)+md(k-(zylza-1)))-(md(k)+md(k+1)).$$

If dmd(i) or dt(k) exceed a threshold value dependent upon the operating point, then one can assume the onset of a combustion.

It is understood that the foregoing description is that of the preferred embodiments of the invention and that various changes and modifications may be made thereto without departing from the spirit and scope of the invention as defined in the appended claims.

What is claimed is:

1. A method for protecting a catalytic converter in the exhaust gas of an internal combustion engine in a starting operation of said engine, the method comprising the steps of:

forming a first index (MZU) for the quantity of an air/fuel mixture which has been metered to said engine and which first reacts exothermally in said catalytic converter downstream of said engine;

recognizing combustions by summing the amounts of the differences between neighboring maxima and minima of the trace of engine speed (rpm) over a camshaft revolution;

comparing said amounts to an operating-point dependent threshold value;

deeming combustions as started when said operating-point dependent threshold value is exceeded;

forming a second index (MV) for an air/fuel quantity which had been combusted;

forming a third index (dM) as a difference of said first and second indices (MZU-MV);

comparing said third index (dM) to a predetermined threshold value; and, cutting off the metering of fuel when said threshold value is exceeded.

2. The method of claim 1, comprising the further step of determining said first index as the air/fuel quantity which has been metered from the beginning of said starting operation up to the onset of combustions.

3. A method for protecting a catalytic converter in the exhaust gas of an internal combustion engine in a starting operation of said engine, the method comprising the steps of:

forming a first index (MZU) for the quantity of an air/fuel mixture which has been metered to said engine and which first reacts exothermally in said catalytic converter downstream of said engine;

determining said first index as the air/fuel quantity which has been metered from the beginning of said starting operation up to the onset of combustions;

forming a second index (MV) for an air/fuel quantity which had been combusted;

forming said second index (MV) by determining the number of combustions which have actually taken place since the beginning of said starting operation;

evaluating the difference between the maximum and the minimum of the trace of the engine speed between two ignitions;

counting as a combustion when said difference exceeds a predetermined threshold;

forming a third index (dM) as a difference of said first and second indices (MZU-MV);

comparing said third index (dM) to a predetermined threshold value; and, cutting off the metering of fuel when said threshold value is exceeded.

4. The method of claim 3, comprising the further step of counting as a combustion when said difference exceeds said predetermined threshold only when the signal of a lambda probe lies in the region about $\lambda=1$.

5. A method for protecting a catalytic converter in the exhaust gas of an internal combustion engine in a starting operation of said engine, the method comprising the steps of:

forming an index for the quantity of an air/fuel mixture which first reacts exothermally in said catalytic converter downstream of said engine;

comparing said index to a predetermined threshold value;

said index being a first index (dM) and forming a second index (MZU) for an air/fuel mixture quantity which has been metered to said engine since the beginning of said starting operation;

forming a third index (MV) for an air/fuel quantity which had been combusted since the beginning of said starting operation;

forming said first index (dM) as a difference of said second and third indices (MZU-MV);

forming said third index (MV) by determining the number of combustions which have actually taken place since the beginning of said starting operation;

evaluating the difference between the maximum and the minimum of the trace of the engine speed between two ignitions;

counting as a combustion when said difference exceeds a predetermined threshold;

the threshold value being dependent upon operating parameters of said engine; and, cutting off the metering of fuel when said threshold value is exceeded.

6. The method of claim 5, wherein said threshold value is dependent upon the temperature of said catalytic converter and said threshold value becomes lower as said temperature of said catalytic converter increases.

* * * * *